United States Patent [19]

Denzler et al.

[11] Patent Number: 4,941,240

[45] Date of Patent: Jul. 17, 1990

[54] BEAM WARPING MACHINE WITH A DEVICE FOR THE MAINTENANCE OF REQUIRED YARN TENSION

[75] Inventors: Karl Denzler, Naila; Alfred Böhm, Naila-Hölle; Alfred Wirth, Schwarzenbach/Wald, all of Fed. Rep. of Germany

[73] Assignee: Liba Maschinenfabrik GmbH, Naila, Fed. Rep. of Germany

[21] Appl. No.: 44,250

[22] PCT Filed: Aug. 20, 1986

[86] PCT No.: PCT/DE86/00338

§ 371 Date: Apr. 22, 1987

§ 102(e) Date: Apr. 22, 1987

[87] PCT Pub. No.: WO87/01141

PCT Pub. Date: Feb. 26, 1987

[30] Foreign Application Priority Data

Aug. 21, 1985 [DE] Fed. Rep. of Germany ..... 3529932

[51] Int. Cl.[5] ..... D02H 13/04; D02H 13/26; B65H 63/036

[52] U.S. Cl. ..... 28/187; 28/194

[58] Field of Search ..... 28/187, 194

[56] References Cited

U.S. PATENT DOCUMENTS 1,452,161 4/1923 Kuenneth ..... 28/194
2,098,418 11/1937 Francis ..... 28/194
2,674,778 4/1954 Morrison et al. ..... 28/194 X
2,797,468 7/1957 Brown ..... 28/194
3,263,297 8/1966 Manning ..... 28/194 X

FOREIGN PATENT DOCUMENTS 3149082 6/1983 Fed. Rep. of Germany .

*Primary Examiner*—Werner H. Schroeder
*Assistant Examiner*—Bradley Kurtz DeSandro
*Attorney, Agent, or Firm*—Dority & Manning

[57] ABSTRACT

Beam warping machine with a device for the maintenance of required yarn tension in a group of yarns (5) with rolls (7, 8; 34, 35, 36) around which said group of yarns is wound following an S-shaped path in continuous operation, said pair of rolls being driven without slippage in a operative position (51), whereby brakes (30) acting upon the warp beam (3) are activated when the machine is stopped while at the same time one of the rolls (7,35) is swivelled radially out of its operative position (51) and away from the yarn group (5), whereby the swivelling motion ends in a slippage position (37) which can be selectively adjusted as to degree of swivelling by means of an adjustment link (39), whereby the yarns in the area of the rolls (7, 8; 34, 35,36) braked with the displacement assumes a path allowing for slippage of the yarn group (5) against the rolls (7, 8; 35, 36), said path being straighter than the S-shape.

10 Claims, 3 Drawing Sheets

BEAM WARPING MACHINE WITH A DEVICE FOR THE MAINTENANCE OF REQUIRED YARN TENSION

BACKGROUND OF THE INVENTION

The invention relates to a beam warping machine with a device for the maintenance of required yarn tension in a group of yarns with rolls around which said group of yarns is wound following an S-shaped path in continuous operation, said pair of rolls being driven without slippage in a operative position whereby brakes acting upon the warp beam are activated when the machine is stopped while at the same time one of the rolls is swivelled radially out of its operative position and away from the yarn group.

Such a machine is known from German document DE-OS 31 49 082.

Such a machine must be taken out of operation by stopping it when a yarn breakage occurs for example, or when a thread end (breakage of yarn filament) is detected. To detect such defects, known monitoring instruments are provided. When a defect is detected the machine involved must be stopped as quickly as possible so that the defective area may not be wound on the warp beam. For this reason, the stopping process must be especially short and take place within less than one second, for example.

The defects described are such as normally affect only one yarn out of a multitude of yarns, e.g. 1000 yarns, so that it is necessary to repair the defect concerned individually, with the winding process continued thereafter. However, the yarn material must not suffer any damage during a stoppage. It is even especially desirable for no change in the buildup of the yarns on the warp beam to occur in the area of the defect, due to the stopping procedure, in addition to the original defect which is repaired by a knot, for example. Such a single knot generally does not attract attention in the fabric produced later on. Considerable change in the buildup of the yarns however, such as for example brief, considerably greater or lower yarn tension due to the stoppage would appear later on in the form of stripes in the finished fabric, detracting from the general appearance of the goods. To be especially avoided is the production of such a great increase in yarn tension, due to rapid stoppage, that damages occur in a number of yarns, as this would in a way multiply the defect originally limited to one single yarn. Slacking of the yarns must also be avoided, however, as it may easily lead to yarn ravelling.

According to DE-OS 31 49 082, the above noted problem is dealt with by swivelling one of the rolls out of the group of yarns to such an extent, when the device is stopped, that the yarns run past this roll at a distance, thus practically preventing that moved away roll from exerting any friction upon the yarns because these are no longer wound around the rolls. To maintain a minimum yarn tension during this process, care must be taken that the warp beam continues to run at first during swivelling of the roll, coming to a stop only when no further yarn length is freed by the swivelling motion of said roll, as is the case when the roll no longer touches the yarns. In order to ensure continued minimum yarn tension when the warp beam is stopped and the roll is swivelled into the outer position, an individual stop brake, activated together with the swivelling of the roll, is provided for each yarn. Aside from the considerable cost involved with individual brakes because of the great number of yarns, it is difficult to synchronize the different events, i.e. the braking of the warp beam, the swivelling of the roll and the activation of the stop brakes so that a minimum yarn tension is also maintained with the desired uniformity.

SUMMARY OF THE INVENTION

It is the object of the instant invention to eliminate synchronization problems and to always ensure maintenance of the required yarn tension when the warp beam machine is stopped from continuous operation. According to the present invention, such is achieved by movement of the roll to a slippage position, the degree of which can be selectively adjusted by means of an adjustment link, whereby the yarns in the area of the rolls braked with the displacement follow a path which is straighter than the S-shape and permits slippage of the yarn group against the rolls.

Because of the displacement of the tensionsing roll into a slippage position, situations dangerous to the yarns may be avoided. Particularly, if the warp beam continues to run briefly as the brake is applied when the tensioning roll has moved to the slippage position, the warp beam can pull the yarns through the rolls with slippage and thus maintain some tension on the yarns. Precise synchronization of the stoppage of the warp beam and the attainment of the slippage position is therefore not required, since the slippage position is attained rapidly and braking of the warp beam is slower in execution than the braking of the tensioning rolls. The pull exerted by the warp beam upon the yarns as it continues to run, ensures that the yarn tension is maintained without danger of yarn breakage since slippage between the yarns and the tensioning rolls is now possible. The existence of yarn slippage across the tensioning roll in the slippage position allows for selective adjustment of the degree of displacement of the tensioning roll and thereby a selective adjustment of the degree of yarn slippage which was not possible with the known devices mentioned earlier. Notably, in the prior art structure the movable roll's position varied only from an operative tensioning position and a position in which it is located at a distance from the yarns and therefore exerts no friction upon said yarns at all. Selective adjustment of the slippage position of the pivotable roll according to the present invention makes it possible to control yarn friction through the particular degree of slippage for each different type of yarn material as is required to maintain the degree of yarn tension necessary in the beaming process within desired limits, even during stopping of the warp beam and while the warp beam is stopped. Friction characteristics of different yarn materials can thus also be taken into consideration.

If two tensioning rolls are used, one of the rolls is best arranged so as to be pivotable around an axle running parallel to the axis of the rolls. A most preferred combination consists in having the swivelling axle proximate the axle of the non-pivotable roll, whereby both rolls can be coupled simply via gears with this coupling being maintained during swivelling of the roll. In the design according to the present invention, a brake installed on one roll only, preferably of the non-swivelling roll, is sufficient.

In a case where three rolls are employed with the yarn group being guided along a double S-shaped path, one S following the other, the middle roll is preferably supported pivotably between the two other rolls.

When a stoppage becomes necessary during the start-up of the machine, a further problem is present. Because of the stopping brakes in the machine according to DE-OS 31 49 082, it must be assumed for such machine that a pivotable roll, activating the stopping brake, is in its operative position before start-up, so that the yarn group goes around the rolls in an S-shaped path at start-up. It has, however, often been observed that a defect, for example yarn breakage, which causes the stoppage of such a known machine frequently occurs and that nevertheless not all defects are discovered at the same time. Furthermore, when a defect is repaired, for example when a broken yarn is knotted, consequential damages, for example ravelling, often occurs on other yarns in the vicinity of the detected defect. When, upon elimination of a defect, another such defect is still present anywhere else and the machine is then started, there immediately occurs yet another additional stoppage of the machine as a necessary consequence of the now detected, second defect. In this operating phase of start-up, the warp beam at first rotates at relatively low speed, so that it is stopped more quickly than the time required for the pivotable roll to move from its operative position to its outer position. This leads to a situation in which the yarns are no longer subjected to any yarn tension and even droop, a situation known to lead regularly to yarn ravelling and thus hampering, if not stopping entirely the continued warping process.

This further problem is solved according to the present invention by partially reversing the displacement of the tensioning roll concerned up to an intermediary position after stoppage of the warp beam. The machine is thus started up with the tensioning roll in an intermediary position, and the pivotable tensioning roll is then returned to its operative position only after run-up or full acceleration of the warp beam.

Thanks to this partial reversal of the swivelling motion, whereby the pivotable tensioning roll assumes an intermediate position between the slippage position and the operative position, a certain amount of pull is exerted on the stopped yarn group, subjecting it to tension and thus counter-acting any droping of the yarn group. On the other hand the tensioning roll in the intermediate position provides a position next to the slippage position from which the roll can be shifted very rapidly into the slippage position. Consequently, if a stoppage condition should occur during start-up, the pivotable tensioning roll can reach its slippage position in time despite the relatively rapid stopping of the warp beam. After run-up or full acceleration the warp beam, the pivotable tensioning roll is brought back into operative position, so that the tensioning roll now assumes the position it normally holds during operation, i.e. its operative position, basically only once the warp beam has reached its full speed. During run-up of the warp beam, at which time further stoppage is likely for the reasons indicated above, the pivotable tensioning roll can thus be transferred rapidly from its intermediary position into its slippage position.

Another method may be practiced to solve the above-mentioned problem during start-up of the machine. Generally such method includes start-up of the machine while tensioning roll is located in a position other than the operative position and from which said pivotable roll can be shifted into operative position at a speed adapted to the acceleration of the warp beam.

In this case, a position other that the operative position, in particular the slippage position, is maintained on purpose so that yarn group may not be endangered by a renewed stopping of the machine. However, to ensure that the operative position required for the operation of the machine is nevertheless reached rapidly, the swivelling of the pivotable roll from the position in question into the operative position occurs at a speed commensurate to the acceleration of the warp beam. That is, the pivotable tensioning roll is still located in a position from which it can be transferred relatively quickly into the slippage position when a stoppage occurs during run-up of the warp beam. Since the speed of the warp beam increases steadily as it runs up or accelerates, the pivotable roller can also move further and further towards its final position, i.e. the operative position, during run up, so that when the warp beam finally reaches its full speed, the pivotable roll has assumed its operative position.

BRIEF DESCRIPTION OF THE FIGURES

Examples of the embodiments of the invention are illustrated in the drawings, in which.

DESCRIPTION OF THE PREFERRED EMBODIMENTS

Figures 1, 4, 5:
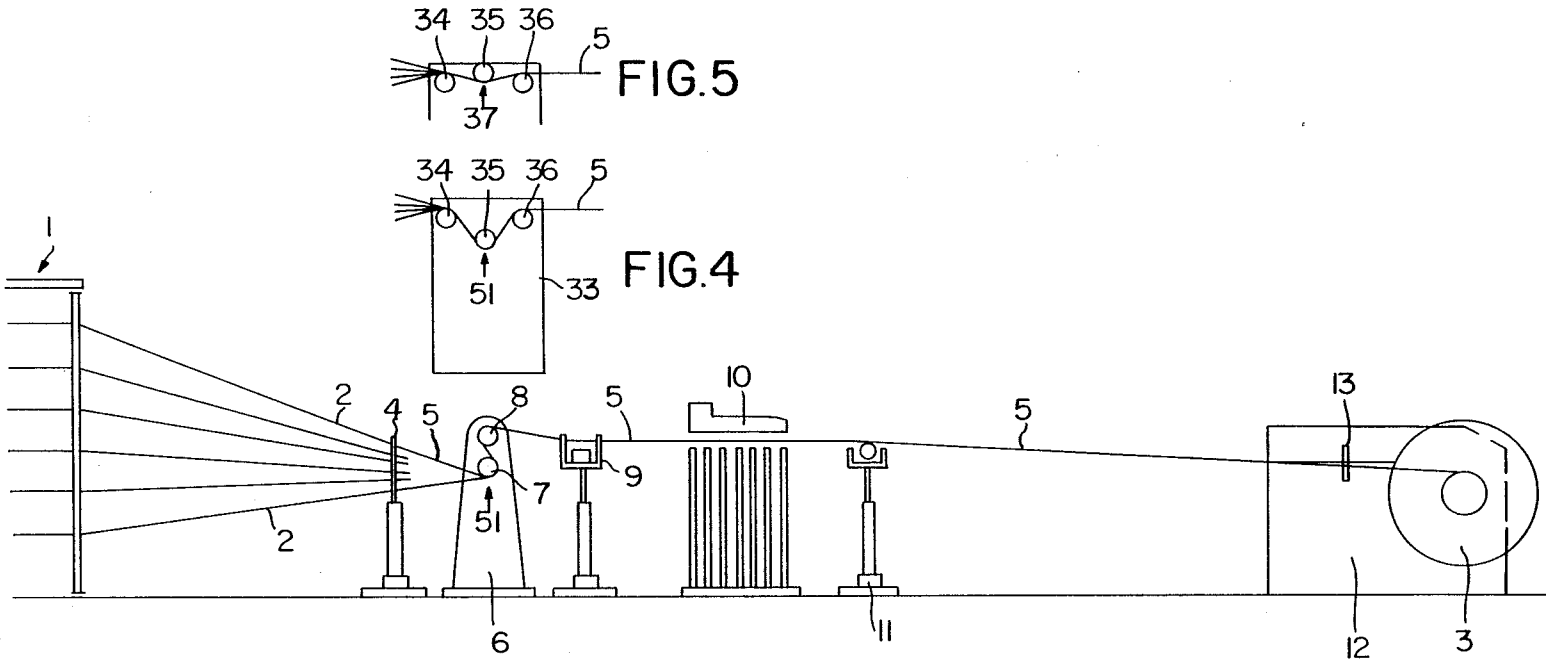
FIG. 1 is a schematic drawing of a beam warping machine with a yarn tensioning device comprising two rolls.
FIG. 4 schematically shows a further embodiment of a tensioning device with three rolls, in normal operation during the beaming operation.
FIG. 5 schematically shows the tensioning device of FIG. 4 with swivelled middle roll located as when braking action occurs.

The beam warping machine shown in FIG. 1 includes a bobbin creel 1 which contains as many bobbins as there are single yarns 2 to be wound on the warp beam 3. The yarns 2 are guided through a reed 4 which arranges the individual yarns 2 into a yarn group 5 in which the individual yarns 2 run next to each other in even distribution. The yarn group 5 then reaches tensioning device 6 which includes two rolls 7 and 8 around which the yarn group 5 passes in the form of an S. Instead of this S-shape it is of course also possible to provide a mirror-image design. Because of this S-shaped path around the rolls 7 and 8, rolls 7 and 8 are driven without slippage, whereby either yarn group 5 drives the rolls 7 and 8, or whereby rolls 7 and 8 are driving the yarn group 5 under the effect of a so-called positive drive of said rolls 7 and 8.

When the yarn group 5 has left the tensioning device 6, it reaches a thread end monitor 9 which will detect the absence of a thread end and thereby stop the machine at the same time. Such thread end monitors are known. FIG. 1 furthermore schematically shows a yarn magazine 10 which is filled in, case of stoppage of the machine due to a yarn defect and reversal of the warp beam in search of the defect. Such magazines are known. Such a magazine is disclosed in DE-PS 25 53 943, for example. It should be pointed out that the machine of the present invention is also fully operational without magazine 10. Following the magazine 10, the yarn group is guided over a conditioning device 11 where the individual yarns can be coated with a finish such as an oil film, for example. Such a conditioning device is also known. It normally consists of a roll over which the yarn group is caused slide and which revolves in a conditioning liquid. The yarn group 5 finally reaches the winding machine 12 which includes a warping reed 13 and a warp beam 3, on which yarn group 5 is wound in a known manner.

The beam warping machines used today run at speeds of approximately 1000 m/min. When the thread end monitor 9, which can be equipped to signal yarn breakage too, signals a defect at these high speeds, the machine must be stopped rapidly enough, if possible, so that the defective area stops before reaching the warping reed 13. In rare instances however, this cannot be accomplished, and the defective spot is wound up on the warp beam 3. In such case, the warp beam 3 must then be unwound in opposite direction while the machine is stopped and the magazine 10 is filled with a corresponding length of single yarns 2 of yarn group 5 until the defective spot becomes visible and can be treated as needed.

The unwinding of the warp beam 3 and the filling of the magazine 10 represent a time-comsuming process which affects the productivity of the beam warping machine. It is therefore desirable to stop the machine as quickly as possible in case of a defect being signaled, so that the defective spot stops before reaching the warping reed 13 and can be eliminated immediately at that location. Such requires a correspondingly rapid braking of the warp beam 3 and of the two rolls 7 and 8. In the machine as shown, the roll 7 is swivelled up and out of its illustrated position which is designated as the operative position 51 (see also FIGS. 2, 3) when the brake is applied, so that the yarn group assumes a straighter path than the S-shape, as is discussed below in further detail with reference to FIGS. 2 and 3. Because the yarn group is guided in this fashion, it can pass with slippage over rolls 7 and 8 so that continued running of the warp beam 3 after the rolls 7 and 8 have stopped cannot affect the yarn tension in yarn group 5. This is due to the fact that in such an instance the on-running warp beam 3 can now pull the yarn group 5 over the braked rolls 7 and 8 thanks to the slippage of said yarn group 5 against said rolls 7 and 8. Of course these are processes lasting no longer than a fraction of a second, but they can be of decisive importance for the efficient operation of the machine. The mentioned swivelling of the roll 7, in particular, takes into account the momentum of the warp beam 3 which is considerably greater than that of rolls 7 and 8, especially when said warp beam 3 is full.

Figures 2, 3:
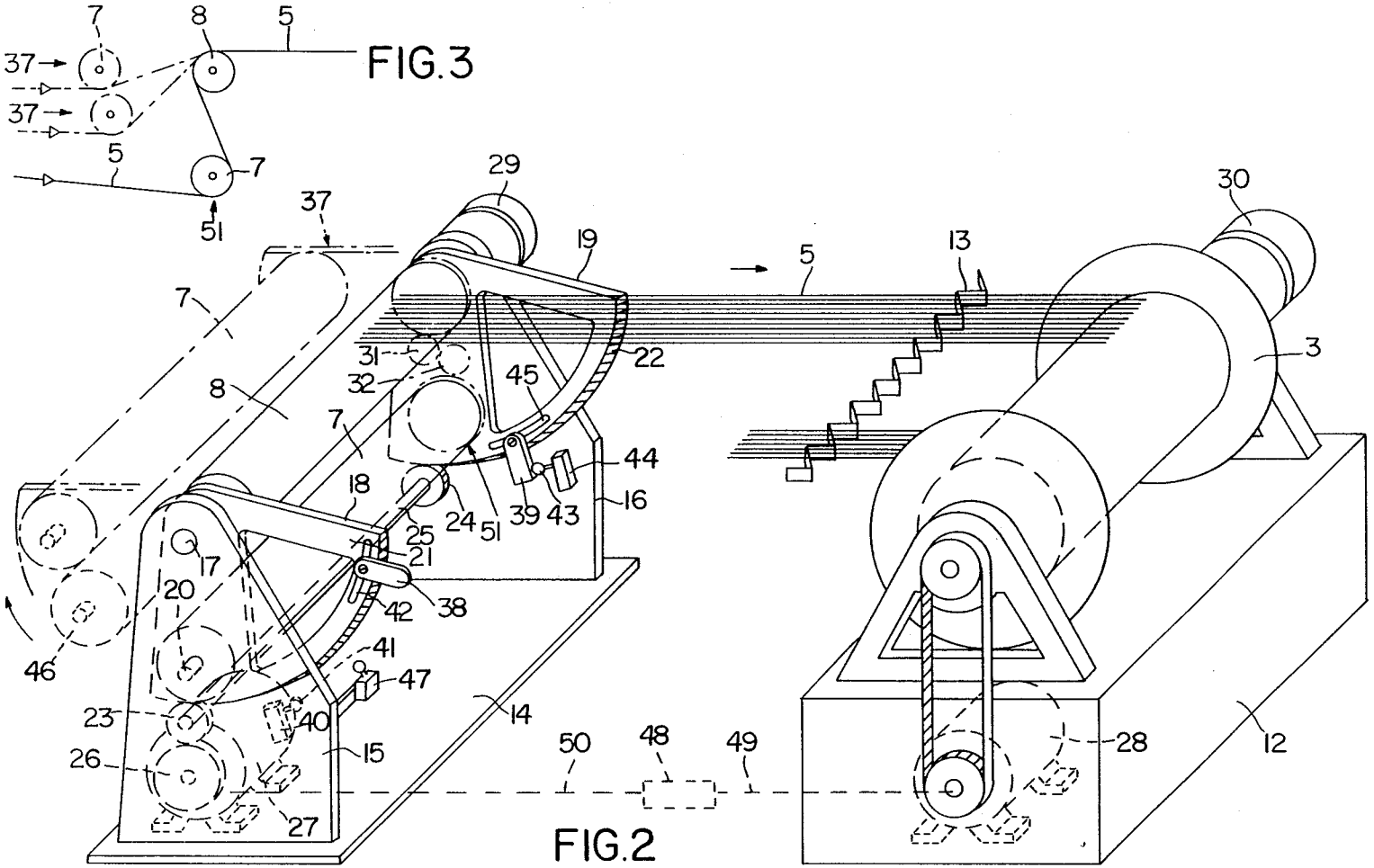
FIG. 2 illustrates a particular design of the tensioning device containing the two rolls in conjunction with a winding machine supporting the warp beam.
FIG. 3 is a schematic drawing of the position of the tensioning rolls in the device as shown in FIGS. 1 and 2 in normal operation and in case of braking.

The tensioning device 6 shown in FIG. 2 consists of a base plate 14 with side plates 15 and 16, in which roll 8 is rotatably supported. Roll 8 rotates around an axle 17 on which the two swivelling arms 18 and 19 are rotatably supported. The swivelling arms 18 and 19 bear an axle 20, on which roll 7 is rotatably supported. The swivelling arms 18 and 19 are equipped with the toothed segments 21 and 22 into which gears 23 and 24, respectively, mesh and which are rigidly supported on a shaft 25. Shaft 25 is supported rotatably in side plates 15 and 16. The connection between the toothed segments 21 and 22 via gears 23 and 24 and shaft 25 ensures that the angles of rotation of the two swivelling arms 18 and 19 are always identical. Gear 23 is coupled to a drive gear 26 which is driven by a drive motor 27. By switching on the drive motor 27, the swivelling arms 18 and 19, and through them roll 7, are swivelled via gears 26 and 23 into the position indicated by a broken line in FIG. 2 in which the yarn group 5 is guided over rolls 7 and 8 in an essentially straight line, so that said yarn group 5 is able to slide past rolls 7 and 8 with slippage in relation to them.

FIG. 2 furthermore shows the warping reed 13 and the winding machine 12 with drive motor 28 which supports and drives the warp beam 3 in a known manner.

Roll 8 and warp beam 3 are equipped with the brakes 29 and 30 respectively which are electrically activated in a known manner by a defect signalled by thread-end monitor 9, for example. This causes drive motor 28 to be switched off simultaneously and drive motor 27 to switched on, so that roll 7 is swivelled from the operative position 51 into the slippage position 37, indicated by broken lines. Drive motor 27 is then switched off in the manner described below when slippage position 37 has been reached. The braking force exerted by brake 29, which at first acts upon roll 8, is transferred by same to roll 7 via gears 31 and 32 indicated by dots and dashes in FIG. 2. The gears 31 and 32 are supported on swivelling arm 19 and mesh into the corresponding teeth of the rolls 8 and 7. This transfer of braking force is maintained, whatever the position into which roll 7 has been swivelled, since the swivelling of roll 7 follows an arc around axle 17.

FIG. 2 furthermore shows the trip cams 38 and 39, mounted on the respective toothed segments 21 and 22, whereby trip cam 38 defines the slippage position 37. When the roll 7 is swivelled into slippage position 37, the trip cam comes into contact with a limit switch 40 mounted on the side plate 15 and thus activates its contact plunger 41, thereby switching off drive motor 27. Trip cam 38 is attached to the toothed segment 21 by means of slot 42, and may be moved therealong so that the slippage position 37 can be adjusted selectively. The operative position of roll 7 is defined by means of trip cam 39, as shown on FIG. 2 by solid lines. Trip cam 39 activates contact plunger 43 of limit switch 44 which is mounted on the side plate 16. The drive motor 27 is switched off by means of limit switch 44 when roll 7 is moved back from slippage position 37 to its operative position 51. This operative position 51 is also selectively adjustable by means of movement of trip cam 39 along its mounting slot 45. It should be pointed out that the drive motor 27 is a so-called brake motor which stops quickly when switched off. This makes it possible to obtain immediate termination of the corresponding swivelling motion of roll 7 as soon as limit switches 40 or 44 are switched off.

The slippage position 37 of roll 7 is illustrated in two selectively adjustable positions as indicated by dots and dashes in FIG. 3. This results in yarn group 5 being guided in a straighter line than the S-shaped path when roll 7 is in the operative position 51, making it possible for yarn group 5 to pass through rolls 7 and 8 as it slips against said rolls. Moreover, as can be seen in FIG. 3, adjustment of slippage position 37 will also vary the degree of slippage of yarn group 5 as it passes rolls 7 and 8.

A variant of tension device 6 of FIG. 1 is shown in FIG. 4. Device 33, shown in FIG. 4 is equipped with three tensioning rolls 34, 35 and 36, whereby yarn group 5 is guided along a path forming a double S and is thereby driven without slippage by rolls 34, 35, 36 or drives the latter. In case of stoppage of the machine, roll 35 can be transferred from its operative position 51 into a slippage position 37, shown in FIG. 5, in which yarn group 5 is then guided along a generally straight path, so that said yarn group 5 can be guided with slippage past rolls 34, 35, 36.

It should also be pointed out that the desired effect of the swivelling of the one roll 7 or 35 into slippage position 37 also occurs if the machine in question is stopped manually. In this case too, the above-mentioned swivelling of roll 7 or 35 ensures that a longer run-off of the warp beam does not result in overloading the yarn group 5.

FIG. 2 also shows the means which are used to solve the problem which arises when the warp beam 3 is stopped while it is still running up, i.e. before it has reached its operating speed. As mentioned earlier, the swivelling movement of roll 7 out of its slippage position 37 is reversed until it is brought back into an intermediate position indicated in FIG. 2 by a broken line representing the roll with the reference 46. 46 thus designates the intermediary position. The transition from the previously assumed slippage position 37 to the intermediary position 46 takes place as follows:

When roll 7 is swivelled out of its operative position 51, represented by solid lines, towards slippage position 37, the toothed segments 21 and 22 are turned about axle 17 by gears 23 and 24 until the trip cam 38 makes contact with contact plunger 41 of limit switch 40, whereby the motor 27 which provides the swivelling motion is switched off. By means of electric controls, a discussion of which is not relevant in this context, motor 27 is again switched on in opposite direction after stoppage of the warp beam and gears 23 and 24 rotate segments 21 and 22 back until the trip cam 38 makes contact with contact switch 47 which switches off motor 27 when thus activated so that, as this swivelling motion ends, roll 7 assumes the intermediary position 46. Appropriate electrical controls ensure that the contact switch 47 is not activated when the massage of the trip cam 38 causes the transfer from the operative position into the slippage position. When the defect which has led to the stoppage of the warp beam 3 has been repaired, motor 28 can then be switched on again for the run-up of the warp beam 3. If a defect is detected at this point, during run-up, the warp beam is again stopped rather rapidly, especially if said warp beam was still in the early stage of its run-up. This rapid stoppage of warp beam 3 requires correspondingly rapid return of the roll 7 into slippage position 37, and this is made possible because the roll only has to be swivelled from intermediary position 46 into slippage position 37, i.e. over a relatively short distance. When the warp beam finally reaches its operating speed in its run-up, electrical controls, the discussion of which is not relevant in this context return the roll 7 into its operative position 51 by switching on motor 27. At this point motor 27 is switched off as described earlier, as trip cam 39 comes into contact with contact plunger 43 of limit switch 44.

The means by which the pivotable roll 7 may be swivelled from a position other than the operative position 51, in particular from slippage position 37, into operative position 51 at a speed which is adapted to the acceleration of warp beam 3 when the machine is started up are also shown schematically in FIG. 2. This is accomplished by means of an electric control device 48, to which a signal representing the speed of motor 28 and thereby the speed of warp beam 3 is transmitted via a measuring lead 49 and which transforms this signal into a control current which is fed via control lead 50 to motor 27. The speed of motor 27 thereby follows the control current coming from control device 48 which is dependent upon the speed of motor 28, as stated above. Control device 48 is a known electrical switch which need not be discussed in this context since the instant invention does not relate to the electrical portion of the machine. The current fed via control lead 50 to motor 27 essentially ensures that roll 7 assumes a position determined by the speed of the warp beam 3 at that moment, between slippage position 37 and operative position 51. This can be achieved by letting the control current 50 run motor 27 at a speed on the basis of which roll 7 follows directly the run-up of warp beam 3 as it is swivelled from the slippage position 37 into the operative position 51.

Figure 6:
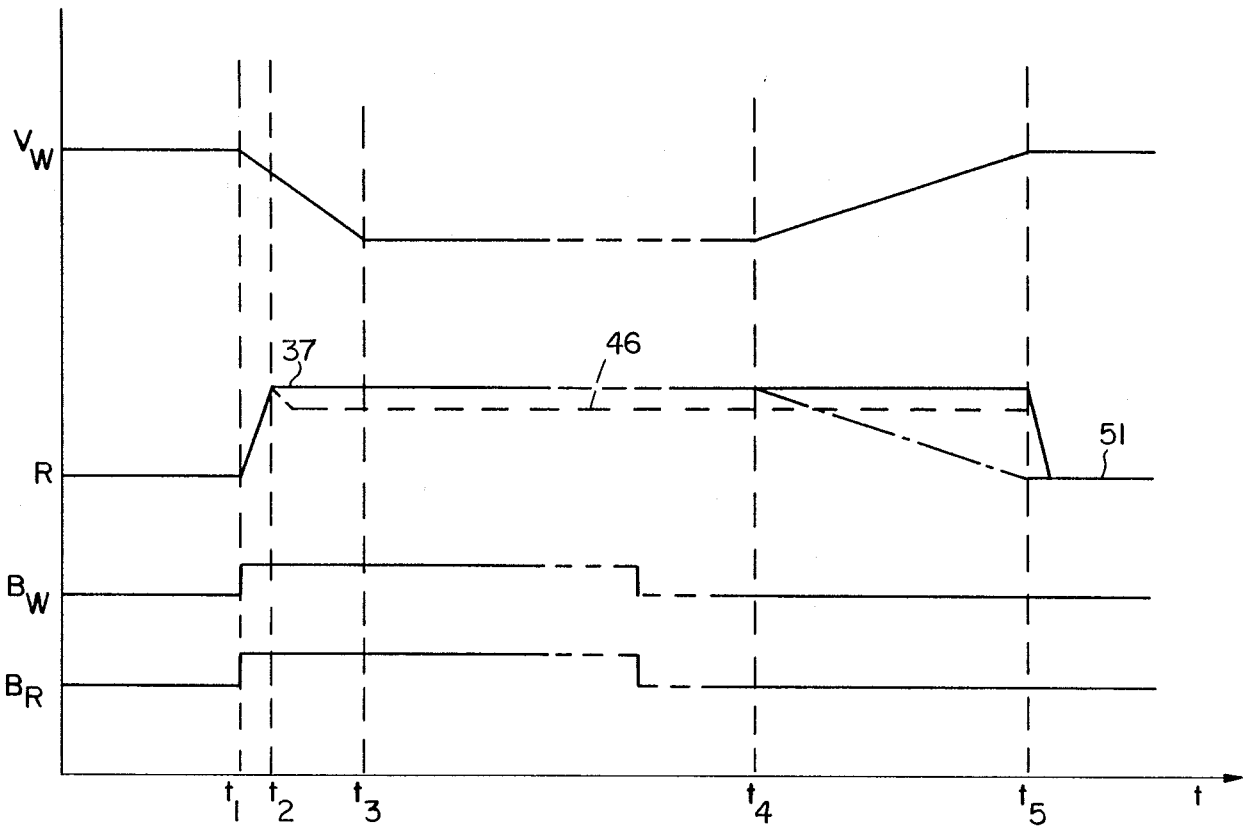
FIG. 6 is a timing diagram illustrating operation of various elements of an apparatus according to the present invention.

FIG. 6 illustrates the relative time operation of the elements of apparatus according to the present invention when, for example a defect, such as a broken end, is detected by thread end detector 9 or the like. Once detector 9 senses an end break, brake 30 is activated (see timing line $B_w$) at a time $t_1$, and drive motor 28 is turned off while warp beam 3, indicated by timing line Vw begins to reduce in speed, and finally comes to a full stop at a time $t_3$. Brake 29 is also activated upon detection of a fault (see timing line $B_R$) and drive motor 27 turned on to act on rolls 7 and 8 as described hereinabove, causing roll 7, indicated by timing line R, to be swivelled out of its operative position 51 and toward its slippage position 37 (see FIGS. 2 and 3), and reaching same at a time $t_2$, while warp beam 3 continues to decelerate until it reaches a standstill at a time $t_3$. Roll 7 is stopped in its intended slippage position 37 when cam 38 reaches limit switch 40 and shuts off drive motor 27. Following complete stoppage of warp beam at time $t_3$, brakes 29 and 30 are released.

The machine is restarted at a time $t_4$ after the defect has been corrected by actuation of drive motor 28, upon which warp beam begins to accelerate (see timing line $V_2$), with roll 7 remaining in the slippage position 37 (timing line R) until beam 3 reaches full acceleration at a time $t_5$, after which roll 7 is swivelled to its operative position 51. Since, however, further end breakage is more likely during reacceleration of warp beam 3, drive motor 27 may be restarted as by electric controls to cause roll 7 may to be returned to an intermediate position (see broken line 46 on timing line R) during start-up of beam 3 so that should an end break out during acceleration, the brakes, etc. will be actuated as noted above and roll 7 will more quickly be returned to its slippage position 37. Without any interruption during start-up, once warp beam reaches full acceleration, drive motor 27 would be started again to return roll 7 to its normal operation position 51.

In an alternative embodiment (see FIG. 2) drive motors 28 and 27 can be operatively connected by way of control device 48 shown in phantom in FIG. 2 so that the input to drive motor 27 is a control current from device 48 based on the speed of drive motor 28. In such arrangement, roll 7, starting at time $t_4$, is gradually returned from its slippage position 37 to its operative position 51 (see timing line R) in accordance with the increase in speed of warp beam 3, with roll 7 reaching its operative position 51 shortly after time $t_5$ when beam 3 reaches its full operational speed.

It will be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit and scope of the invention herein disclosed.

What is claimed is:

1. In a beam warping machine having a device for the maintenance of required yarn tension in a group of yarns being wound onto a beam which includes a plurality of rolls about which the group of yarns passes in a tortuous path and with said rolls being driven without slippage in an operative position, and having means to move one of said rolls out of the operative position upon actuation of brake means for stoppage of the machine to a location where yarns in said yarn group may pass across said rolls with slippage, the improvement comprising adjustment means associated with said one movable roll for determining the amount of movement of said roll from its operative position so that when said brake means is actuated, said one roll is moved away from its operative position to a location where a straighter yarn path is presented through said tension device and a predetermined amount of slippage exists between said yarns and said rolls while maintaining contact with said yarn.

2. Apparatus as defined in claim 1 wherein two rolls are included in said device for maintenance of yarn tension, said movable roll being supported for pivotal movement around an axle which is parallel to the rolls.

3. Apparatus as defined in claim 1, wherein three rolls included in said device for maintenance of yarn tension, with the yarn group running along a path which describes two successive S-shapes, and wherein the middle roll is supported between the other two rolls for pivotal movement.

4. Apparatus as defined in claim 1 wherein means are provided to return the movable roll to an intermediary position from the location where slippage occurs from which the start-up of the machine takes place, and for returning the movable roll to its operative position only after completed run-up of the warp beam.

5. Apparatus as defined in claim 1 comprising further control means associated with the beam and the movable roll to cause said movable roll to return to the operative position at a speed commensurate with the acceleration of the beam.

6. Apparatus for winding yarn around a beam comprising:

(a) beam support frame for rotatably supporting a beam thereon;

(b) drive means operably associated with said support frame to drive a beam received on said frame;

(c) yarn storage means spaced apart from said beam support frame to receive packages of yarn thereon to be wound onto said beam;

(d) yarn tensioning means located along a yarn path between said yarn storage means and said support frame, said yarn tensioning means including a plurality of rolls, one of said rolls being movable between a first operative position in which the rolls define a tortuous yarn path thereabout and in which position yarns passing thereabout interact with said rolls in the absence of slippage and a second position in which said rolls define a yarn path less tortuous than in said operative position and in which yarns pass thereabout with slippage;

(e) means operatively associated with said one movable roll for moving same between said first and second position, [said roll movement means being adjustable to effectuate movement of said roll to predetermined other positions between said first and second positions;]

(f) brake means associated with said beam support and one of said rolls of said tensioning means for interrupting the winding operation in the event of yarn breakage, [said brake means being associated with said roll means to actuate said roll movement means upon actuation of said brake means] so that during stopping of said beam, said one roll is moved to a position where yarns passing through said tensioning means follows the less tortuous path with slippage between said yarns and said rolls while maintaining contact therebetween.

7. Apparatus as defined in claim 6 wherein said tensioning means includes two rolls, said rolls in the operative position defining an S-shaped yarn path thereabout.

8. Apparatus as defined in claim 7 wherein said one movable roll is supported for pivotal movement on an axle parallel to the other roll.

9. Apparatus as defined in claim 8 wherein said axle is supported on two arms which, in turn, are supported on the axle of the said other roll.

10. Apparatus as defined in claim 6 wherein said tensioning means includes three tensioning rolls, said one movable roll being located between the other two rolls and wherein said three rolls in the operative position define a yarn path thereabout having two successive S-shapes.

* * * * *